US009820344B1

(12) United States Patent
Papanicolaou

(10) Patent No.: US 9,820,344 B1
(45) Date of Patent: Nov. 14, 2017

(54) LED THYRISTOR SWITCHED CONSTANT CURRENT DRIVER

(71) Applicant: Elias S Papanicolaou, San Jose, CA (US)

(72) Inventor: Elias S Papanicolaou, San Jose, CA (US)

( * ) Notice: Subject to any disclaimer, the term of this patent is extended or adjusted under 35 U.S.C. 154(b) by 47 days.

(21) Appl. No.: 14/544,711

(22) Filed: Feb. 9, 2015

(51) Int. Cl.
*H05B 33/08* (2006.01)

(52) U.S. Cl.
CPC ..... *H05B 33/0815* (2013.01); *H05B 33/0809* (2013.01)

(58) Field of Classification Search
CPC ..... H05B 33/0815; H05B 33/0809
See application file for complete search history.

(56) References Cited

U.S. PATENT DOCUMENTS 3,518,520 A * 6/1970 Molnar ..... H02P 7/295 388/830
2009/0212721 A1 8/2009 Maruyama
2009/0323238 A1* 12/2009 Gehrke ..... H05B 33/089 361/56
2010/0033113 A1* 2/2010 Maruyama ..... H05B 33/0812 315/309
2013/0154482 A1* 6/2013 Ge ..... H05B 33/0887 315/121
2013/0271007 A1* 10/2013 Huang ..... H05B 37/02 315/121

* cited by examiner

*Primary Examiner* — Douglas W Owens
*Assistant Examiner* — Pedro C Fernandez

(57) ABSTRACT

A circuit for controlling power to a load from a rectified AC supply is disclosed. The load like an LED or another type is driven by a power device such as a MOSFET or a transistor. The power device is biased from a resistive string which also includes a thyristor switch in series combination. At a specific trigger or conduction angle of the thyristor switch the proper bias for the power device is obtained to enable the load current to remains fairly constant with AC supply voltage fluctuations or loading. Furthermore the trigger circuit of the thyristor switch is properly configured in order for the load current to stay constant or even change with ambient temperature variations as well.

19 Claims, 5 Drawing Sheets

LED THYRISTOR SWITCHED CONSTANT CURRENT DRIVER

FIELD OF THE INVENTION

The present invention relates to a thyristor switched current source circuit with compensation for power supply voltage and ambient temperature variations. It can be used to provide constant current to LED and other loads.

WORD AND SYMBOL EXPLANATIONS

Whenever the following words or symbols are encountered in this document their true meaning would be as stated below.

LED: Light emitting diode.

Load: Electrical load

LED load: One LED or more LEDs in series or parallel connections that would allow the LEDs when activated to be forward biased.

deg. C.: Degree or degrees Celsius.

mA: Milliampere or milliamperes. The milliampere is a unit of current equal to one thousandth of an ampere.

mV: Millivolt or millivolts. The millivolt is a unit of voltage equal to one thousandth of a volt.

kohm: Kiloohm or kiloohms. The kiloohm is a unit of electrical resistance equal to one thousand ohms.

BACKGROUND OF THE INVENTION

In an LED driver circuit it is essential for the LED current to be controlled or kept constant over the expected range of power supply voltage variations and ambient temperature changes. The simplest method to somewhat stabilize the current of an LED would be to use a resistor in series connection with an LED load. But this method has serious drawbacks. In order for the resistor to act more like a current source its value must be large. This would keep the power dissipation on the resistor low but would limit the number of LEDs that can be driven with one resistor. If a low value resistor is used more LEDs can be accommodated but at higher temperatures or supply voltages the power dissipation on the resistor may turn out to be excessive. Hence, with the resistor methodology there is not really current control and at high ambient temperatures or high line voltage conditions the change in the LED load current can shorten the life of the LEDs and can even result in thermal run-away, poor illumination, degradation and sometimes even a total damage to the LEDs.

There is a large number of circuits in prior art designed to stabilize the LED current for power supply voltage and/or ambient temperature variations. These circuits are driven from low AC voltage sources that are rectified with bridge rectifiers before being converted to DC. In order to obtain a pure DC voltage and eliminate rectifier bridge ripple voltage, high quality smoothing capacitors must be used. Such capacitors are bulky, expensive and have a short lifetime as well. Circuits for power factor correction (PFC) are also required. Variable duty cycle control circuits may be included as well most likely for controlling LED illumination by means of pulse width modulation (PWM) techniques that control the LED load current. Also in order for these circuits to provide a constant current for the LED load over a wide DC power supply voltage range, linear regulators or the switched type of regulators like boost or buck converters are used.

BRIEF SUMMARY OF THE INVENTION

The present invention is a thyristor switched current source designed to provide constant current to LED and other loads. The thyristor switch can be an SCR or a TRIAC or an equivalent circuit for an SCR or a TRIAC. This circuit, by utilizing a triggered thyristor, is driven from an unsmoothed rectified AC voltage source. Without a high quality smoothing electrolytic capacitor the LED load voltage is a 120 Hz rectified AC voltage waveform. This type of a voltage is actually more desirable than a pure DC by virtue of the fact that LED lifetime is increased if the LED is not fully on constantly. Furthermore, the LED load voltage waveform is sinusoidal and in phase with the AC supply voltage waveform. Hence, no coils and expensive electrolytic capacitors or any other hardware for power factor correction (PFC) is necessary. There is also no problem with the LED illumination exhibiting flicker. With the LED current being switched at a rate of 120 Hz and in the absence of any pulse width modulation (PWM) the LED illumination would appear continuous to the human eye. It should also be noted here that thyristor circuits, as is the case with other high frequency switching LED circuits, generate electromagnetic interference (EMI). However if the thyristor circuit in this invention is driven from the secondary side of a transformer, as should be the case with low voltage applications, the conductive part of EMI can be prevented from getting to the primary side of the transformer and to other electrical lines. As for the radiated part of EMI none was detected in the most critical AM band of radio with the thyristor circuit driven from the secondary side of a transformer.

In the present invention the LED or any other load is driven from a power device such as a MOSFET, a JFET or a transistor. The power device is biased for activation from a resistive string which essentially constitutes the load of the thyristor. Now if the thyristor is set to trigger only at a predetermined voltage point on the AC supply voltage waveform the LED load current can remain fairly constant with power supply voltage fluctuations or loading. In other words, with power supply voltage variations the bias on the resistive string also varies by the amount needed for the current in the power device or the LED load to remain constant. The bias change in the resistive string with power supply voltage variations is attributed to shifts in the thyristor trigger angle. The thyristor performs still another function by making possible that the bias change with temperature in the resistive string enables the LED load current to remain constant with ambient temperature variations as well. Without the thyristor compensation for changes in the LED load current for AC supply voltage and ambient temperature variations could not have been achieved with conventional biasing schemes. Most likely two different sets of hardware would have been required. The type of temperature compensation here would be for the current in the power device to either remain constant or change as required. This can be done by using in the trigger circuit of the thyristor a zener diode or another electrical component with positive or negative temperature coefficient. For example, a component with negative temperature coefficient can cause the current in the power device to start falling off at higher temperatures a feature which with an LED load can be desirable for preventing any deterioration in the life and illumination of the LEDs. Temperature compensation, as is the case with the AC supply voltage variations, is attributed to shifts in the thyristor trigger angle except that in this case the trigger angle of the thyristor is not confined to a specific point on the AC supply voltage waveform. However, any shift in the triggering point on the AC supply voltage waveform would be minor and would not affect the proper operation with AC supply voltage variations.

Therefore, a general object of this invention is to provide a current source circuit for LED and other loads where the load current must stay constant with power supply voltage fluctuations.

Another object of this invention is to provide a current source circuit for LED and other loads where the load current must stay constant with power supply loading.

Another object of this invention is to provide a current source circuit for LED and other loads where the load current must stay constant with ambient temperature variations.

Another object of this invention is to provide a thyristor voltage source for biasing external power devices driving LED and other loads that require for the load current to stay constant with power supply voltage and ambient temperature variations.

Yet another object of this invention is to provide a current source circuit for LED and other loads where the load current is allowed to vary with ambient temperature variations.

Still another object of this invention is to maximize the useful life of the LED by insuring that the LED current stays within the allowable limits with power supply voltage and temperature variations.

A further object of this invention is to provide a constant current source driver circuit which is durable, versatile and cost effective. This circuit is composed of discrete components but with the bill of materials being very short and in the absence of large capacitors and coils the manufacturing cost would be comparable to a circuit with an integrated driver.

DETAILED DESCRIPTION OF THE PREFERRED EMBODIMENTS

Figure 1:
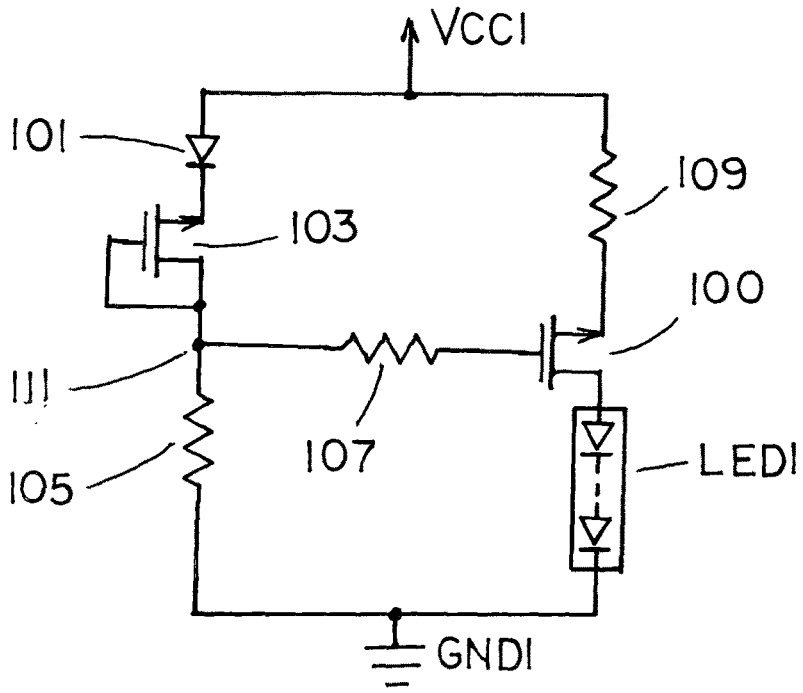
FIG. 1 PRIOR ART
FIG. 1 shows a schematic diagram of a prior art P-CHNNEL MOSFET LED driver with the LED current staying constant with power supply voltage variations or loading.

Shown in FIG. 1 is a prior art current source driver for LED and other loads. The load current in this circuit is independent of supply voltage changes but not for ambient temperature variations. In the circuit both transistors are the P-CHANNEL MOSFET type with source, gate and drain terminals as depicted. These transistors can also be substituted with the PNP type of transistors with emitter, base and collector terminals being the MOSFET source, gate and drain terminals respectively. AC supply Vcc1 is the positive side of a DC voltage source or the positive side of an unsmoothed rectified AC voltage source. The negative side of voltage source Vcc1 is connected to ground GND1. The source terminal of transistor 100 is connected to supply Vcc1 by way of resistor 109. The drain terminal of transistor 100 is returned to ground GND1 via load LED1. Resistor 107 is connecting the gate terminal of transistor 100 to node 111 on the bias string comprising diode 101, diode connected transistor 103 and resistor 105. The gate-to-source voltage of transistor 100 is compensated with the gate-to-source voltage of transistor 103. Hence, the load LED1 current is primarily set with the forward voltage of diode 101 appearing across resistor 109. Now since the diode 101 forward voltage hardly changes with supply Vcc1 voltage variations or loading the load LED1 current stays constant. With ambient temperature changes the gate-to-source voltage variation of transistor 100 can easily be compensated with a similar variation of the gate-to-source voltage of transistor 103. This is fine but the variation with temperature of the forward voltage of diode 101, responsible for setting the load LED1 current, is a problem. If diode 101 is bipolar with a temperature coefficient of −2 mV/deg. C. the load LED1 current can vary by as much as 30% with a change of 100 deg. C. in ambient temperature. Furthermore and in order to minimize the voltage drop across resistor 109 if diode 101 is a low forward voltage Schottky diode with a temperature coefficient of −1.2 mV/deg. C. the load LED1 current can vary by as much as 50% for a 100 deg. C. change in ambient temperature.

Figure 2:
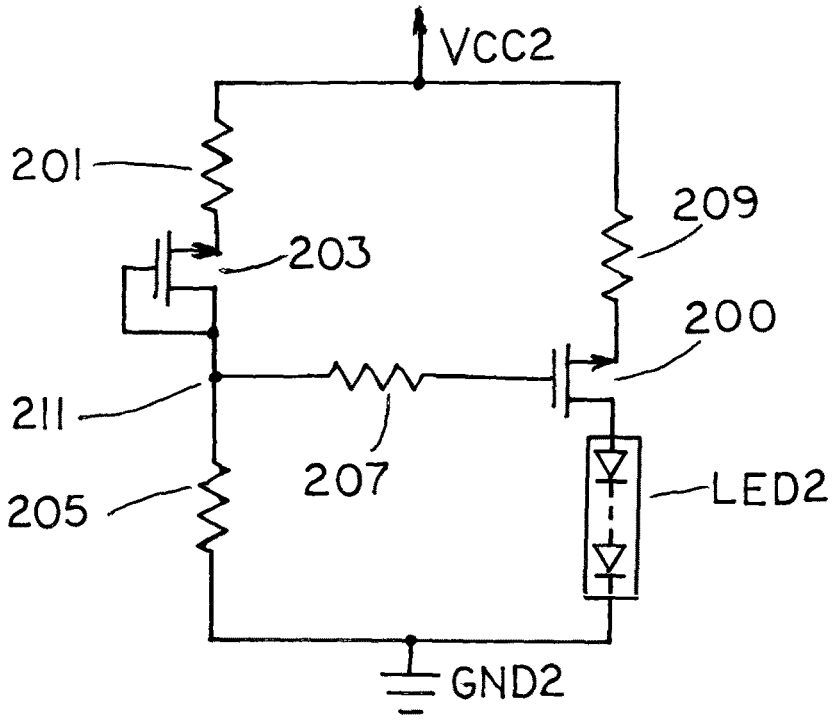
FIG. 2 PRIOR ART
FIG. 2 shows a schematic diagram of a prior art P-CHNNEL MOSFET LED driver with the LED current staying constant with ambient temperature changes.

Shown in FIG. 2 is a prior art current source driver for LED and other loads. The load current in this circuit is independent of ambient temperature variations but not for supply voltage fluctuations. In the circuit both transistors are the P-CHANNEL MOSFET type with source, gate and drain terminals as shown. These transistors can also be substituted with the PNP type of transistors with emitter, base and collector terminals being the MOSFET source, gate and drain terminals respectively. AC supply Vcc2 is the positive side of a DC voltage source or the positive side of an unsmoothed rectified AC voltage source. The negative side of voltage source Vcc2 is connected to ground GND2. The source terminal of transistor 200 is connected to Vcc2 by way of resistor 209. The drain terminal of transistor 200 is returned to ground GND2 via load LED2. Resistor 207 is connecting the gate terminal of transistor 200 to node 211 on the bias string comprising diode 201, diode connected transistor 203 and resistor 205. The gate-to-source voltage of transistor 200 is compensated with the gate-to-source voltage of transistor 203. Hence, the load LED2 current is set with the voltage across resistor 201 also appearing across resistor 209. In this circuit the load LED2 current is independent of ambient temperature variations. The reason is that transistors 200 and 203 by being properly matched have similar temperature characteristics. Any variation with ambient temperature in the gate-to-source voltage of transistor 200 would be compensated with a similar variation in the gate-to-source voltage of transistor 203 in such a way that the bias at node 211 would not be affected. However, compensation for changes in the load LED2 current with supply Vcc2 voltage variations or loading is not expected to be the case in this circuit. Any change in the supply Vcc2 voltage would affect the voltage across resistor 209 and hence the load LED2 current. For a 20% change in the supply Vcc2 voltage there would be a 30% change in the load LED2 current.

Figure 3:
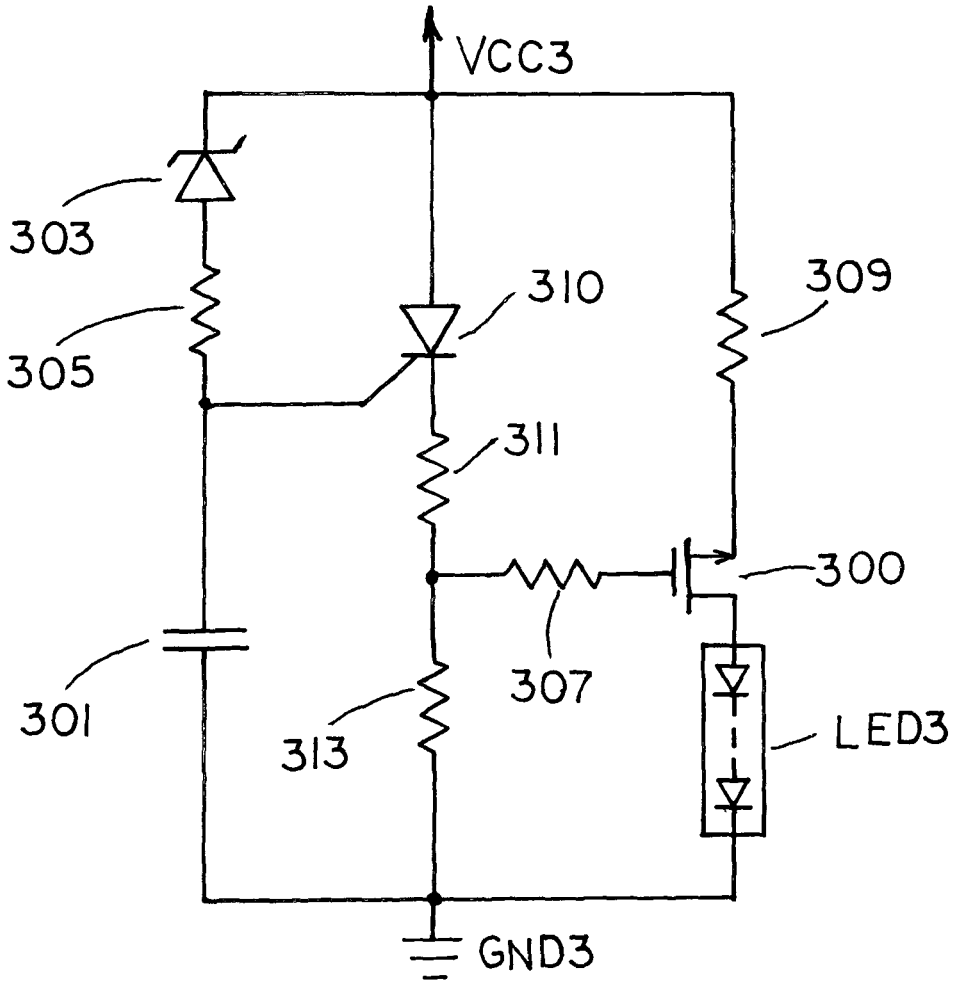
FIG. 3 shows a schematic diagram of a thyristor switched P-CHNNEL MOSFET current source LED driver according to at least one embodiment of the present invent ion.

According to at least one embodiment of the present invention depicted in FIG. 3 is a schematic diagram of a thyristor switched current source driver for LED and other loads. In this circuit the load current is independent of supply voltage and ambient temperature variations. The circuit is driven by an unsmoothed rectified AC voltage source having positive and negative sides connected to supply Vcc3 and ground GND3 terminals respectively. Thyristor 310 having input, output and control terminals is driven from supply Vcc3 shown connected to thyristor 310 input terminal. The output terminal of thyristor 310 is returned to ground GND3 via resistors 311 and 313 in series connection. Thyristor 310 control terminal is connected to supply Vcc3 by way of a trigger circuit comprising a series combination of resistor 305 and zener diode 303 operable in reverse or breakdown mode. Included in the trigger circuit of thyristor 310 is capacitor 301 connected between the thyristor 310 control terminal and ground GND3. Transistor 300 is a P-CHNNEL MOSFET having source, gate and drain terminals as depicted in a conventional diagram for a MOSFET. Transistor 300 can also be a PNP transistor with emitter, base and collector terminals being the MOSFET source, gate and drain terminals respectively. The source terminal of transistor 300 is connected to supply Vcc3 by way of resistor 309. The transistor 300 drain terminal is returned to ground GND3 via load LED3. Resistor 307 is connecting the gate terminal of transistor 300 to the voltage divider common point of resistors 311 and 313. The reason for this divider is to obtain the correct bias for the transistor 300 gate terminal without allowing a large initial voltage drop across thyristor 310. Another reason is that by utilizing resistor 311 dimming can be introduced in the LEDs of load LED3. By adjusting lower resistor 311 the bias at the gate terminal of transistor 300 is increased and this would cause the voltage across resistor 309 and the load LED3 current to be lowered. Another way of introducing dimming in the LEDs of load LED3 is by adjusting lower resistor 305. This time the voltage across thyristor 310 is reduced and this would cause the bias at the gate and source terminals of transistor 300 to go higher and the load LED3 current to go lower.

Figure 5A:
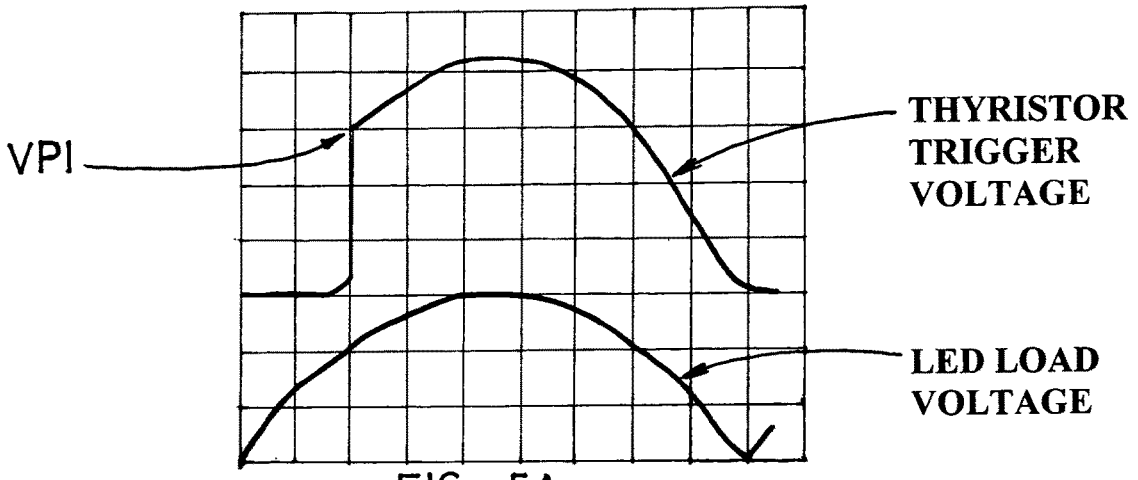
FIGS. 5A, 5B and 5C show half-cycle of rectified AC voltage versus time waveforms of the load and thyristor triggering for a P-CHNNEL MOSFET current source LED driver.
Figure 5B:
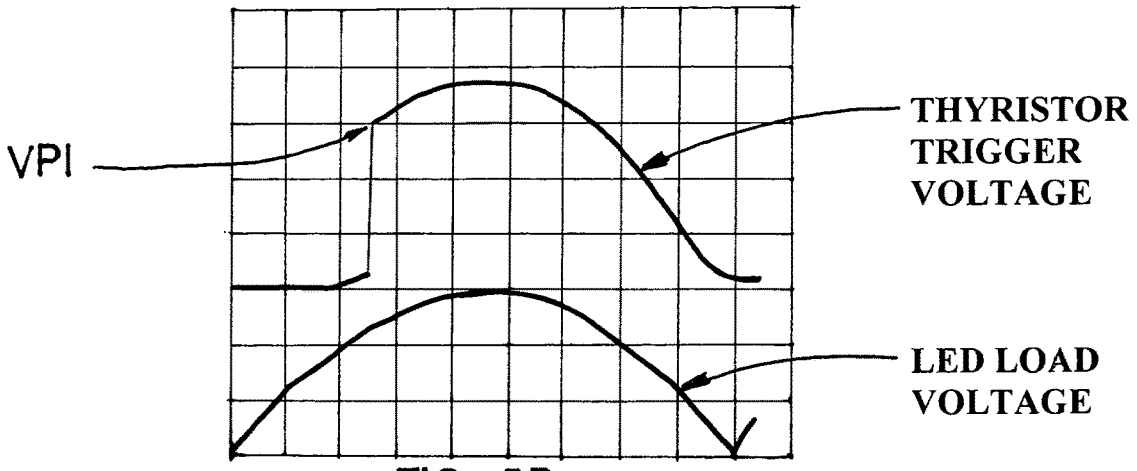
Figure 5C:
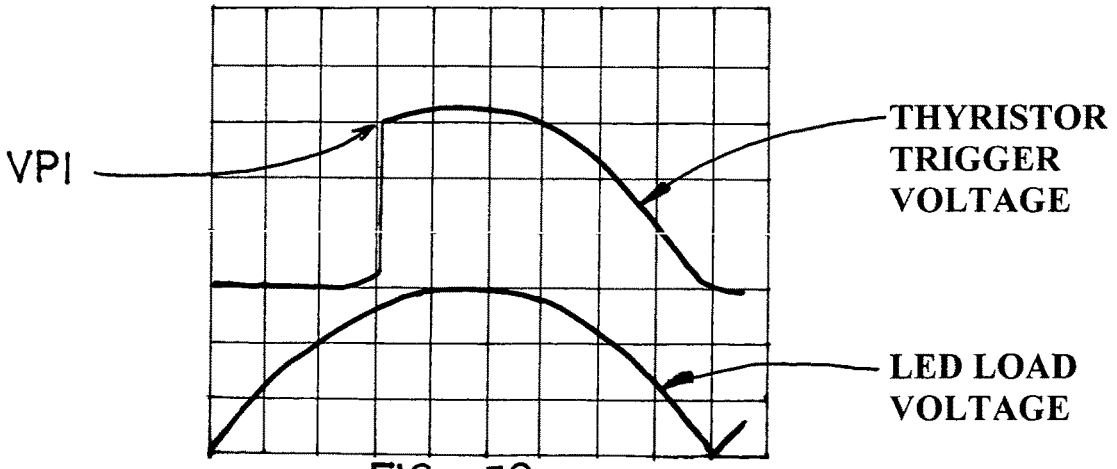

Half-cycle rectified AC oscilloscope voltage versus time waveforms for thyristor 310 triggering and load LED3 are shown in FIGS. 5A, 5B and 5C for supply Vcc3 voltage changes form high to nominal to low respectively. Any change in the supply Vcc3 voltage would affect the voltage across resistor 309 and hence the load LED3 current. What actually happens is that a change in supply Vcc3 voltage, as a result of shifts in the thyristor 310 trigger angle, would affect the voltage across thyristor 310 as well as the bias on the divider of resistors 311 and 313 and through resistor 307 the bias of the transistor 300 gate and source terminals. As shown in the thyristor 310 voltage waveforms of FIGS. 5A, 5B and 5C, triggering on the AC supply Vcc3 voltage waveform occurs at the same voltage point VP1 which, for example, may be taken to be about 15 volts. By properly selecting the triggering point VP1 on the supply Vcc3 voltage waveform and keeping it constant for supply Vcc3 voltage variations, the correct bias is obtained at the gate and source terminals of transistor 300 to prevent the load LED3 current from changing. Thyristor 310 by controlling the voltage on the bias string of resistors 311 and 313 enables the load LED3 current to stay constant for ambient temperature variations as well. This would not have been the case with conventional biasing schemes. Transistor 300 gate terminal is returned to ground GND3 by way of resistors 307 and 313. This would enable transistor 300 to be operable even before any triggering of thyristor 310 as shown in FIGS. 5A, 5B and 5C load LED3 voltage waveforms. Also indicated in FIGS. 5A, 5B and 5C is that all load LED3 voltage waveforms are of the same amplitude, sinusoidal and in phase with the supply Vcc3 voltage waveforms. Capacitor 301 can be omitted if thyristor 310 triggering is not needed beyond 90 electrical degrees. As an example, in FIGS. 5A, 5B and 5C thyristor 310 may be looked at as triggering at about 40, 50, and 60 electrical degrees respectively. For sensitive thyristor 310 the control terminal input current is low and being the only current through resistor 305 requires for resistor 305 have a large value. It is actually more desirable for resistor 305 to have a lower value in which case triggering desensitization of thyristor 310 can be employed. This is done by connecting a small value resistor between the control and output terminals of thyristor 310.

Temperature compensation must be carried out for variations in the load LED3 current as well as the voltage in the thyristor 310 load of resistors 311 and 313. This compensation can be carried out by utilizing the positive temperature coefficient of the operable in reverse or breakdown mode zener diode 303 voltage to offset temperature related changes due to negative temperature coefficients of the thyristor 310 control terminal input current and control terminal to output terminal voltage. The change in the thyristor 310 control terminal input current is manifested as a voltage change across resistor 305. Compensation must also be carried out for the transistor 300 source-to-gate voltage variation with temperature. This again can be done by utilizing the variations with temperature of the zener diode 303 voltage and the thyristor 310 control terminal input current. However with MOSFET devices the temperature coefficient of the gate-to-source voltage can be both positive and negative and cancel each other out at some value of drain current. Therefore, if transistor 300 is set to operate at the zero temperature coefficient point for the gate-to-source voltage then temperature compensation would reestablish the selected triggering point VP1 on the AC supply Vcc3 voltage waveform and the load LED3 current would be constant for ambient temperature changes as well as supply Vcc3 voltage variations. In the event of having variation with temperature in the gate-to-source voltage of transistor 300 temperature compensation can still be achieved but with a shift in the triggering point VP1 on the AC supply Vcc3 voltage waveform. However, if the components used are selected with the proper electrical characteristics, the shift with temperature of the triggering point VP1 on the AC supply Vcc3 voltage waveform, would have only a minor effect on the change of the load LED3 current with supply Vcc3 voltage variations. Also the triggering point VP1 on the AC supply Vcc3 voltage waveform can always be adjusted to accommodate the variation with temperature of the transistor 300 gate-to-source voltage. With a sensitive thyristor 310 the control terminal input current is very low and being the only current through resistor 305 requires for the value of resistor 305 to be large. Actually in this case and for less troublesome temperature compensation it would be better if the value of resistor 305 is not very large. One way of doing this would be to desensitize the triggering of thyristor 310. This can be done by connecting a small value resistor between the thyristor 310 control terminal and output terminal. The result would be additional current in resistor 305 and this would require for resistor 305 to have a lower value. For example, a resistor of 1 kohm would increase the current in resistor 305 by 0.65 mA if the thyristor 310 control terminal to output terminal voltage is 0.65 volts.

Excessive shifts with temperature of the predetermined triggering point VP1 on the AC supply Vcc3 voltage waveform can still be realized if a large change in the load LED3 current is required. For example, for the triggering point VP1 to shift lower for reduction in the load LED3 current at higher temperatures may require for the zener diode 303 voltage to be lower or the zener diode 303 be replaced with a negative temperature coefficient resistor.

Figure 4:
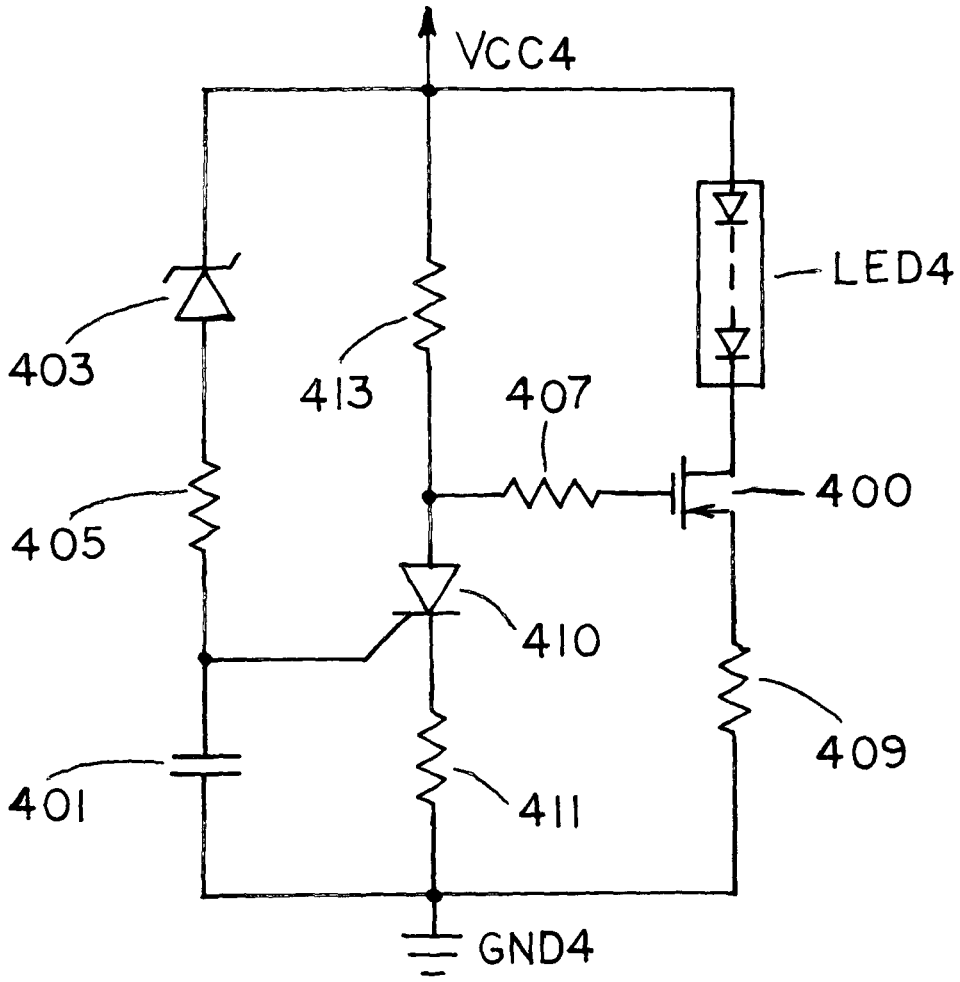
FIG. 4 shows a schematic diagram of a thyristor switched N-CHNNEL MOSFET current source LED driver according to still another embodiment of the present invention.

According to another embodiment the circuit depicted in FIG. 4 is the N-CHNNEL MOSFET version of the circuit in FIG. 3. It is a thyristor switched current source driver for LED and other loads. In this circuit the load current is also independent of supply voltage and ambient temperature variations. The circuit is driven by an unsmoothed rectified AC voltage source having positive and negative sides connected to supply Vcc4 and ground GND4 terminals respectively. Thyristor 410 having input, output and control terminals is driven from supply Vcc4 shown connected to thyristor 410 input terminal by way of resistor 413. The output terminal of thyristor 410 is returned to ground GND4 via resistor 411. Thyristor 410 control terminal is connected to supply Vcc4 by way of a trigger circuit comprising a series combination of resistor 405 and zener diode 403 operable in reverse or breakdown mode. Included in the trigger circuit of thyristor 410 is capacitor 401 connected between the thyristor 410 control terminal and ground GND4. The reason for the thyristor load of resistors 411 and 413 being split up is for the gate terminal of transistor 400 to have the proper bias without a large voltage drop across thyristor 410. This is no different form the way it is done in the circuit of FIG. 3 where the bias at the gate terminal of transistor 300 is set with the voltage drop across thyristor 310 and resistor 311. Another reason is that with resistor 411 dimming can be introduces in the LEDs of load LED4. By adjusting lower resistor 411 the bias at the gate terminal of transistor 400 is lowered and this would cause the voltage across resistor 409 and the load LED4 current to be lowered. Another way of introducing dimming in the LEDs of load LED4 is by adjusting lower resistor 405. This time it is the reduction of the voltage across thyristor 410 that would cause the bias at the gate terminal of transistor 400 to go lower. Transistor 400 is an N-CHNNEL MOSFET having source, gate and drain terminals as depicted in a conventional diagram for this type of a MOSFET. Transistor 400 can be an NPN transistor with emitter, base and collector terminals being the MOSFET source, gate and drain terminals respectively. Transistor 400 can also be an integrated base bipolar transistor (IGBT) with emitter, base and collector terminals being the MOSFET source, gate and drain terminals respectively. The source terminal of transistor 400 is connected to ground GND4 by way of resistor 409. The transistor 400 drain terminal is returned to supply Vcc4 via load LED4. Resistor 407 is connecting the gate terminal of transistor 400 to thyristor 410 input terminal. The reason for that is for the gate of transistor 400 to be biased from supply Vcc4 through resistors 407 and 413 in order for transistor 400 to be operable even before any triggering of thyristor 410.

Figure 6A:
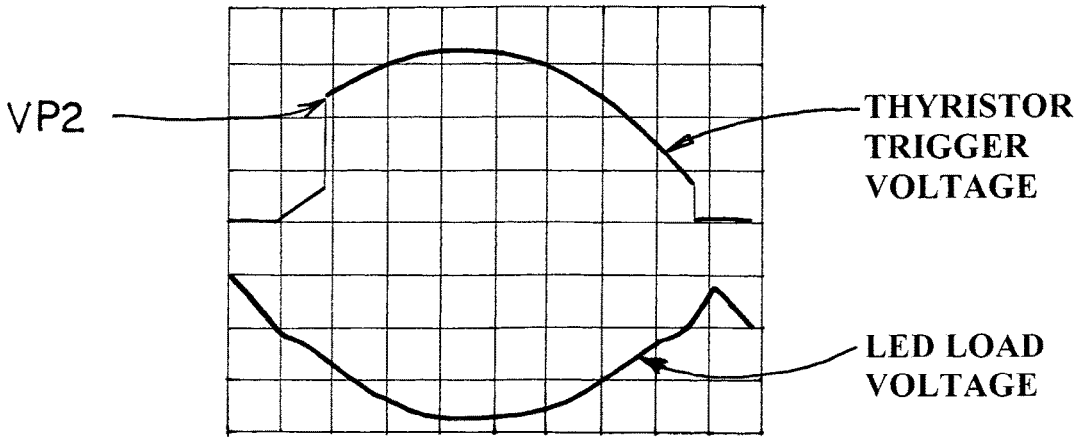
FIGS. 6A, 6B and 6C show half-cycle of rectified AC voltage versus time waveforms of the load and thyristor triggering for an N-CHNNEL MOSFET current source LED driver.
Figure 6B:
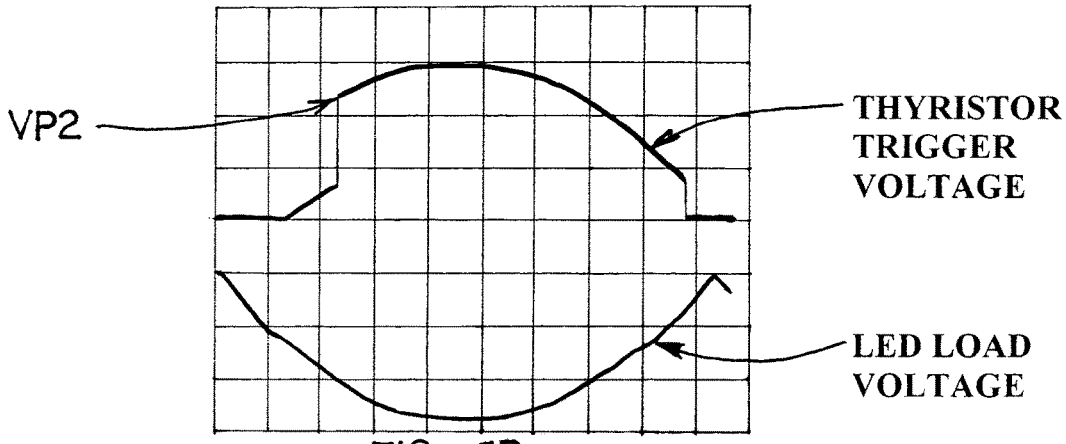
Figure 6C:
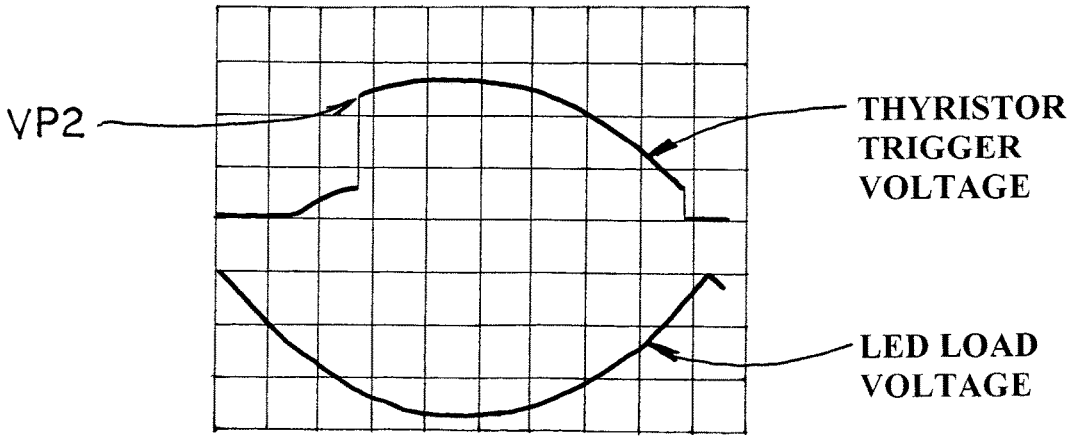

The operation of the circuit in FIG. 4 is similar to the P-CHANNEL MOSFET circuit of FIG. 3 in spite of the fact that some components are rearranged with respect to supply Vcc4 and ground GND4. The load LED4 current is set with resistor 409 which this time is returning the source terminal of transistor 400 to ground GND4. Load LED4 is now connected between supply Vcc4 and the drain terminal of transistor 400. In this circuit the load LED4 voltage waveform is referenced to supply Vcc4. It is also sinusoidal and in phase with the AC supply Vcc4 voltage waveform. Again by properly selecting a triggering point VP2 on the supply Vcc4 voltage waveform and keeping it constant with supply Vcc4 voltage variations the correct bias is obtained at the gate and source terminals of transistor 400 to prevent the load LED4 current from changing. It is actually the variation of the voltage across thyristor 410 that enables the biasing scheme used to work properly, that is, to prevent the load LED4 current from changing not only for supply Vcc4 voltage fluctuations but also for ambient temperature variations. Capacitor 401 can be omitted if no thyristor 410 triggering is needed beyond 90 electrical degrees. Half-cycle rectified AC oscilloscope voltage versus time waveforms for thyristor 410 triggering and load LED4 are shown in FIGS. 6A, 6B and 6C for supply Vcc4 voltage changes form high to nominal to low respectively.

Compensation for temperature related changes in the current of load LED4 and the voltage in the thyristor 410 load of resistors 411 and 413 can be carried out the same way as with the circuit of FIG. 3. This compensation can be done by utilizing the positive temperature coefficient of the operable in reverse or breakdown mode zener diode 403 voltage to offset temperature related changes in the thyristor 410 control terminal input current and control terminal to output terminal voltage and the transistor 400 gate-to-source voltage. The change in the thyristor 410 control terminal input current can be looked at as voltage change across resistor 405. Resistors with positive or negative temperature coefficients can also be utilized in place of zener diode 403 to obtain large changes in the load LED4 current. Also with a sensitive thyristor 410 having low control terminal input current it may be necessary to desensitize the triggering of thyristor 410 in order to increase the current through resistor 405. This can be done by connecting a small value resistor between the control terminal and output terminal of thyristor 410. The result would be a higher current through resistor 405 which would enable resistor 405 to have a lower value and make compensation for temperature related changes in the load LED4 current easy to achieve.

It could be apparent to those skilled in the art that modifications and variations can be made to the preferred embodiments of this invention without departing from the scope or spirit of the invention as defined by the appended claims. One very obvious modification would be to duplicate the preferred embodiments of this invention by referring to the actual components of a thyristor equivalent circuit. Another modification would be to have the thyristor circuit incorporated in the same substrate as the MOSFET.

What is claimed is:

1. A circuit for controlling the power to a load from an AC supply and preventing the power in the load from changing with ambient temperature variations and AC supply voltage fluctuations or loading comprising;

a thyristor having input, output and control terminals, said input terminal is connected to a positive side of an AC supply of rectified form while said output terminal is connected to a negative side of said AC supply by way of a resistive divider comprising a first resistor and a second resistor in series connection;

a transistor having first, second and third terminals and operable to conduct current when said first terminal is connected to the positive side of said AC supply by way of a current setting third resistor, said third terminal is connected to the negative side of said AC supply via a load and said second terminal is connected through a bias setting fourth resistor to a common point of said first resistor and said second resistor; and a trigger circuit comprising a fifth resistor and an operable in reverse or breakdown mode zener diode in series combination connected between the positive side of said AC supply and said control terminal to render said thyristor conductive to prevent current changes in said load with said AC supply voltage fluctuations and temperature variations by setting an operating trigger point on said AC supply voltage waveform and by utilizing a positive temperature coefficient of said zener diode and a current in said trigger circuit to adjust a bias voltage on said second terminal, thereby with the adjustment in the bias voltage of said second terminal the said load current stays constant with said AC supply voltage fluctuations or loading and ambient temperature variations in the environment of said thyristor and said trigger circuit.

2. The circuit of claim 1, further comprises a capacitor connected between said control terminal and the negative side of said AC supply, to enable said thyristor to achieve trigger angles beyond 90 electrical degrees.

3. The circuit of claim 1, wherein said thyristor is a TRIAC and said thyristor input, output and control terminals are main two, main one and gate electrodes respectively.

4. The circuit of claim 1, wherein said thyristor is an SCR and said thyristor input, output and control terminals are anode, cathode and gate electrodes respectively.

5. The circuit of claim 1, wherein said first or said second resistor is variable to enable the current in said load to change by adjusting the bias voltage on said second terminal.

6. The circuit of claim 1, further comprises a resistor connected between said control terminal and said output terminal to desensitize said thyristor and enable the current in said trigger circuit to increase.

7. The circuit of claim 1 wherein said load comprises one or more LEDs or strings of LEDs connected in a way that would enable the LEDs to be turned on when activated.

8. The circuit of claim 1, wherein said transistor is a P-CHANNEL MOSFET and said transistor first second and third terminals are source, gate and drain electrodes respectively.

9. The circuit of claim 1, wherein said transistor is a PNP transistor and said transistor first second and third terminals are emitter, base and collector electrodes respectively.

10. A circuit for controlling the power to a load from an AC supply and preventing the power in the load from changing with ambient temperature variations and AC supply voltage fluctuations or loading comprising;

a thyristor having input, output and control terminals, said input terminal is connected to a positive side of an AC supply of rectified form by way of a first resistor while said output terminal is connected to the negative side of said AC supply by way of a second resistor;

a F transistor having first, second and third terminals and operable to conduct current when said first terminal is connected to the negative side of said AC supply by way of a current setting third resistor, said third terminal is connected to the positive side of said AC supply via a load and said second terminal is connected through a bias setting fourth resistor to said thyristor input terminal; and a trigger circuit comprising a fifth resistor and an operable in reverse or breakdown mode zener diode in series combination connected between the positive side of said AC supply and said control terminal to render said thyristor conductive to prevent current changes in said load with said AC supply voltage fluctuations and temperature variations by setting an operating trigger point on said AC supply voltage waveform and by utilizing a positive temperature coefficient of said zener diode and a current in said trigger circuit to adjust a bias voltage on said second terminal, thereby with the adjustment in the bias voltage of said second terminal the said load current stays constant with said AC supply voltage fluctuations or loading and ambient temperature variations in the environment of said thyristor and said trigger circuit.

11. The circuit of claim 10, further comprises a capacitor connected between said control terminal and the negative side of said AC supply, to enable said thyristor to achieve trigger angles beyond 90 electrical degrees.

12. The circuit of claim 10, wherein said thyristor is a TRIAC and said thyristor input, output and control terminals are main two, main one and gate electrodes respectively.

13. The circuit of claim 10, wherein said thyristor is an SCR and said thyristor input, output and control terminals are anode, cathode and gate electrodes respectively.

14. The circuit of claim 10 wherein said first or said second resistor is variable to enable the current in said load to change by adjusting the bias voltage on said second terminal.

15. The circuit of claim 10, further comprises a resistor connected between said control terminal and said output terminal to desensitize said thyristor and enable the current in said trigger circuit to increase.

16. The circuit of claim 10 wherein said load comprises one or more LEDs or strings of LEDs connected in a way that would enable the LEDs to be turned on when activated.

17. The circuit of claim 10, wherein said transistor is a N-CHANNEL MOSFET and said transistor first second and third terminals are source, gate and drain electrodes respectively.

18. The circuit of claim 10, wherein said transistor is a NPN transistor and said transistor first second and third terminals are emitter, base and collector electrodes respectively.

19. The circuit of claim 10, wherein said transistor is an integrated base bipolar transistor (IGBT) and said transistor first second and third terminals are emitter, base and collector electrodes respectively.

* * * * *